US012553340B2

(12) United States Patent
Hall et al.

(10) Patent No.: US 12,553,340 B2
(45) Date of Patent: Feb. 17, 2026

(54) MULTI-PROBE FORMATION SAMPLING INSTRUMENT

(71) Applicant: Baker Hughes Oilfield Operations LLC, Houston, TX (US)

(72) Inventors: Emiliano Hall, Jandakot (AU); Adnan Khan, Houston, TX (US); Sefer Coskun, Houston, TX (US); Anup Hunnur, Houston, TX (US); Russell McEacharn, Houston, TX (US); Shiva Paramhans, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 537 days.

(21) Appl. No.: 17/877,026

(22) Filed: Jul. 29, 2022

(65) Prior Publication Data

US 2024/0035377 A1 Feb. 1, 2024

(51) Int. Cl.
*E21B 49/10* (2006.01)

(52) U.S. Cl.
CPC ..... *E21B 49/10* (2013.01)

(58) Field of Classification Search
CPC ..... E21B 49/10
See application file for complete search history.

(56) References Cited

U.S. PATENT DOCUMENTS

| | | | |
|---|---|---|---|
| 2002/0178804 | A1 | 12/2002 | Manke et al. |
| 2015/0027696 | A1 | 1/2015 | Kim et al. |
| 2016/0010455 | A1 | 1/2016 | Naveena-Chandran et al. |
| 2016/0053612 | A1 | 2/2016 | Proett et al. |
| 2017/0370216 | A1 | 12/2017 | Morgan |
| 2018/0252100 | A1 | 9/2018 | Ranjan et al. |
| 2018/0371904 | A1* | 12/2018 | Van Zuilekom ..... E21B 49/10 |
| 2023/0091554 | A1* | 3/2023 | Ball ..... E21B 33/127 166/387 |

OTHER PUBLICATIONS

International Search Report and Written Opinion issued Nov. 14, 2023 in PCT Application No. PCT/US2023/028581.

* cited by examiner

*Primary Examiner* — Kristina M Deherrera
*Assistant Examiner* — Jean F Morello
(74) *Attorney, Agent, or Firm* — Hogan Lovells US LLP

(57) ABSTRACT

A downhole testing and sampling system includes a downhole tool, a conveyance system, and a testing and sampling tool forming a portion of the downhole tool. The testing and sampling tool including a first sampling modality and a second sampling modality. One or both of the first sampling modality or the second sampling modality may be deployed to collect a formation sample based, at least in part, on one or more formation properties.

17 Claims, 11 Drawing Sheets

MULTI-PROBE FORMATION SAMPLING INSTRUMENT

BACKGROUND

1. Field of the Disclosure

The present disclosure relates to a system and method for downhole testing and sampling instruments. Specifically, the present disclosure relates to a testing and sampling instrument that can operate in multiple different operational modes using different members.

2. Description of Related Art

Oil and gas production may involve downhole operations involving testing and samples may be obtained from a formation. It may be advantageous to test and collect "clean" formation fluid during these samples, as other downhole fluids, such as drilling mud, may not provide information indicative of the hydrocarbons within the formation. Testing and obtaining clean samples may be challenging due to the operational realities, such as filling a wellbore with fluids for pressure control, drilling fluid infiltration during drilling operations, and the like. As a result, multiple different functionalities are needed and may be deployed with different operational properties in order to try and overcome the challenges of testing and sampling.

SUMMARY

Applicant recognized the limitations with existing systems herein and conceived and developed embodiments of systems and methods, according to the present disclosure, for improved testing and sampling instruments.

In an embodiment, a tool for testing and sampling downhole fluid collection includes a first member being deployable to expand against a wellbore wall. The testing and sampling tool also includes a second member being deployable to expand against the wellbore wall. The tool further includes a testing and sampling segment between the first member and the second member. The testing and sampling segment includes a fluid port or multiple ports extending into a body of the testing and sampling segment, the fluid port being coupled to a fluid mover to draw fluid from a sampling region into the sampling segment. The testing and sampling segment also includes one or more members positioned on the body of the testing and sampling segment, the one or more members being deployable to extend radially away from the body. The fluid port(s) and the one or more members are configured to operate based at least in part on a selected mode of operation for the testing and sampling tool.

In an embodiment, a downhole testing and sampling system includes a downhole tool, a conveyance system, and a testing and sampling tool forming a portion of the downhole tool. The testing and sampling tool includes multiple sampling modalities, where, wherein one or all of the sampling modalities may be deployed to collect a formation sample based, at least in part, on multiple formation properties.

In an embodiment, a method for testing and collecting a formation sample includes deploying a testing and sampling tool into a wellbore. The method also includes determining a mode of operation based, at least in part, on one or more formation properties. The method further includes activating at least one or all of the members. The method includes testing and collecting the formation sample or formation properties using one or more testing and sampling modalities associated with the tool.

In an embodiment, a formation testing and sampling tool for downhole fluid collection includes a first component being deployable to expand against a wellbore wall and a second component being deployable to expand against the wellbore wall. The formation testing and sample tool also includes a testing and sampling segment between the first component and the second component. The sampling segment includes a fluid port extending into a body of the sampling segment, the fluid port being coupled to a fluid mover to draw fluid from a sampling region into the sampling segment. The sampling segment also includes one or more members positioned on the body of the sampling segment, the one or more members being deployable to extend radially away from the body. The fluid port and the one or more members are configured to operate based at least in part on a selected mode of operation for the testing and sampling tool.

In an embodiment, a downhole testing and sampling system includes a downhole tool, a conveyance system, and a testing and sampling tool forming a portion of the downhole tool. The sampling tool including a first sampling modality and a second sampling modality. One or both of the first sampling modality or the second sampling modality may be deployed to collect a formation sample based, at least in part, on one or more formation properties.

In an embodiment, a method for collecting a formation sample includes deploying a sampling tool into a wellbore. The method also includes determining a mode of operation based, at least in part, on one or more formation properties. The method further includes activating at least one of a member or a component. The method includes collecting the formation sample and properties using one or more sampling modalities associated with the testing and sampling tool.

BRIEF DESCRIPTION OF DRAWINGS

The present technology will be better understood on reading the following detailed description of non-limiting embodiments thereof, and on examining the accompanying drawings, in which.

DETAILED DESCRIPTION

Figure 1:
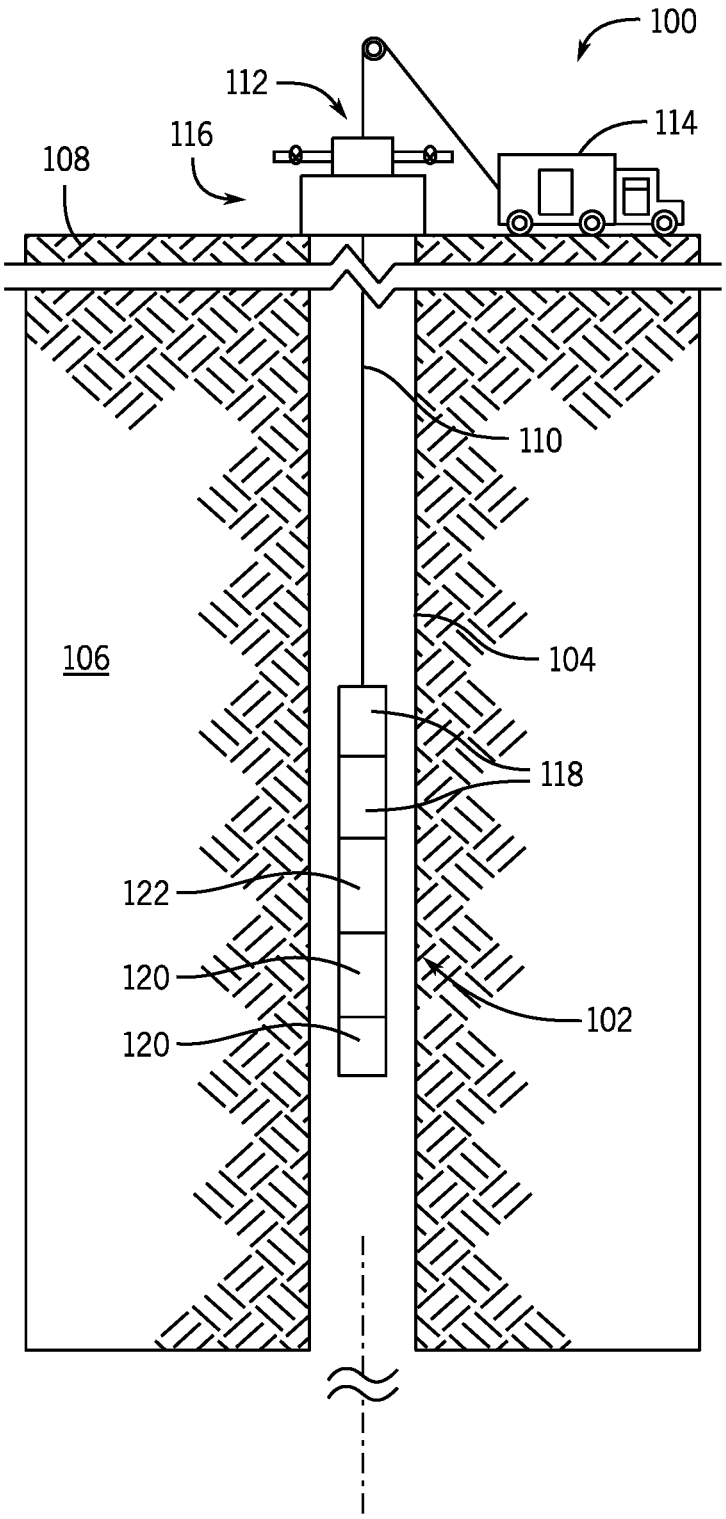
FIG. 1 is a cross-sectional side view of an embodiment of a wellbore system, in accordance with embodiments of the present disclosure.

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose. Additionally, references numerals may be reused for similar features between figures, however, such use is not intended to be limiting and is for convenience and illustrative purposes only.

When introducing elements or members of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions.

Embodiments of the present disclosure are directed toward a testing and sampling instrument with multiple different operational modes using one or more different testing and sampling modules into a single downhole tool. Various embodiments may include a singular tool that integrates both probe style modules and packer style modules into a single sampling configuration. The testing and sampling instrument may operate in different modes of operation. For example, a first mode of operation may correspond to operation that utilizes both the probe and packer simultaneously and/or at substantially the same time. A second mode of operation may correspond to operation that utilizes only the packer. A third mode of operation may correspond to operation that utilizes only the probe. Furthermore, when using only the probe, the packers may be engaged or disengaged, and as a result, the third mode of operation may be considered as both third and fourth modes of operation. In this manner, embodiments of the present disclosure may be directed toward an integrated multi-probe tool that may be used to obtain formation parameters and downhole formation samples.

Various embodiments overcome problems with existing tool designs. For example, while focused sampling has been proven to have the ability to acquire clean formation fluid samples in the shortest time and safest manner, with low fluid mobility there are limits of what the current tool designs, such as concentric probes or packers, can do. There are challenges that are related to different members and one or more embodiments of the present disclosure overcome these challenges. To overcome this challenge and gain the ability to test formations and sample clean formation fluid, embodiments of the present disclosure have been developed. Various embodiments involve combining probe style modules and inflatable style modules (e.g., a straddle packer style module) into a single module. As a result of the combination, a single module is provided that may be used in almost all testing and sampling conditions while also providing for a shorter tool string length.

In at least one embodiment, the sampling instrument includes a multi arm configuration (e.g., 2 arms, 3 arms, 4 arms, 6 arms, any reasonable number of arms) that include probe style packers between a set of inflatable packer elements. The distance between the inflatable packer elements is flexible so as to aid in all types of formations. The packers are isolated and would inflate or deflate in tandem or individually. In at least one embodiment, the inflatable packer elements may be moved while the tool is at an uphole position (e.g., outside the wellbore before deployment) or may be moved while the tool is an a downhole position (e.g., within the wellbore after deployment). The multi arms may all be individually controlled and may be deployed even without the inflatable elements. Accordingly, embodiments may be directed toward a set of multi arm extension style members set between a pair of inflatable members where an area isolated between the two inflatable members is the area from where the zone would be cleaned up as a whole, while the extended arm style member would then collect the cleaner sample from in between the isolated interval. As a result, embodiments describe a configuration that may permit variable, flexible operation with multiple different operational modes, which may be based, at least in part, on one or more formation properties.

Various embodiments may be overcome problems associated with sampling efficiency in lower mobility formations. For example, current tools may be restricted by packer limits on how quickly a space within the formation may be pumped. Increased pumping durations may be more costly, as an operator may pay for deployment or operating times, and as a result, it is desirable to collect samples as quickly and efficiently as possible. Embodiments of the present disclosure may overcome these challenges by being useful in both low mobility and other formations. For example, embodiments provide a focusing effect and allows faster pumping on the isolated interval between the packers. With the new improved pumping capabilities, this would be a proper use of the higher rates achievable even in lower mobilities.

FIG. 1 is a schematic cross-sectional view of an embodiment of a wellbore system 100 including a downhole tool 102 arranged within a wellbore 104 formed in a formation 106. The downhole tool 102 is lowered from a surface location 108 via a conveyance system, such as the illustrated wireline 110, which is shown by way of example only and it should be appreciated that embodiments may be utilized with different conveyance systems. In various embodiments, the electric wireline may transmit electric signals and/or energy from the surface location 108 into the wellbore, for example to provide operational power for the tool 102 and/or to transmit data, such as data obtained from sensors arranged on the tool 102. In various embodiments, the tool 102 may be utilized to perform downhole operations, such as measurement operations, by way of example. It should be appreciated that embodiments exist where the downhole tool 102 is deployed with any other type of conveyance means, including coiled tubing, pipes, cable, and slickline. That is, embodiments of the present disclosure may be utilized in other scenarios.

The wellbore system 100 includes a wellhead assembly 112, shown at an opening of the wellbore 104, to provide pressure control of the wellbore 104 and allow for passage of equipment into the wellbore 104, such as the cable 110 and the tool 102. In this example, the cable 110 is a wireline being spooled from a service truck 114. The wellhead assembly 112 may include a blowout preventer (BOP) 116 (e.g., pressure control device).

In various embodiments, the downhole tool 102 is a testing and sampling, logging, or measurement tool, such as a formation sampling tooling, which may include a series of subs or modules coupled together. In this example, support subs 118 are illustrated with a sampling sub 120 and additional auxiliary subs 122. It should be appreciated that this configuration is shown for illustrative purposes only and there may be more or fewer subs. In various embodiments, the collection of subs, or a subset of subs, may be referred to as a bottom hole assembly (BHA). Various embodiments of the present disclosure may incorporate multiple operational modes into a single section of the BHA, thereby decreasing BHA length, which may be advantageous for deployment.

In this example, the sampling sub 120 may correspond to a multi-member formation testing and sampling tool that may utilized two or more different testing and sampling configurations in order to extract fluid from the formation. In at least one embodiment, the multi-member configuration may operate in different operating modes, which may include several members operating simultaneously and/or substantially simultaneously or only a single member operating. Furthermore, embodiments may further provide for a testing and sampling sub 120 that may adjust one or more parameters according to one or more formation properties.

Figure 2A:
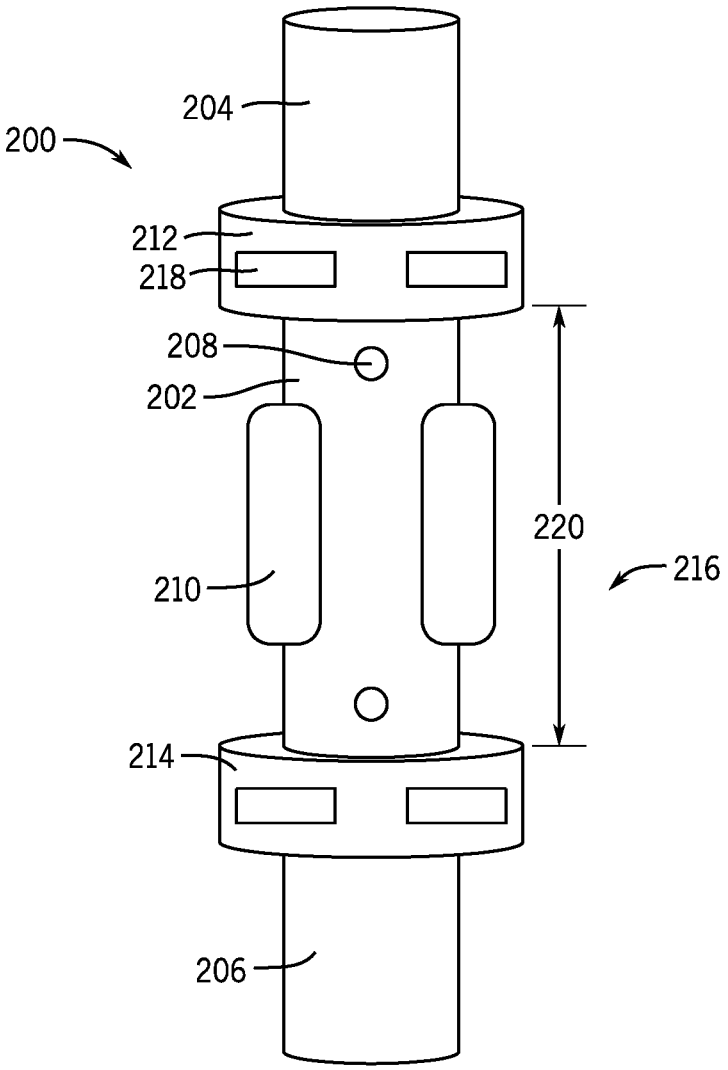
FIG. 2A is a schematic side view of an embodiment of a testing and sampling tool, in accordance with embodiments of the present disclosure.

FIG. 2A is a schematic diagram of an embodiment of a downhole testing and sampling tool 200 that may be used with various embodiments of the present disclosure. It should be appreciated that one or more components of the tool 200 have been removed or simplified for the following discussion. Moreover, while embodiments may be described with respect to wireline operations, it should be appreciated that various embodiments may be incorporated into other types of downhole deployment systems, such as along hard piping.

In this example, the tool 200 includes a sampling segment 202 positioned between an upper segment 204 (e.g., a first segment) and a lower segment 206 (e.g., a second segment). The sampling segment 202 is illustrated as an annular, tubular region that may be arranged within a wellbore. In this example, the sampling segment 202 includes ports 208 for receiving fluid, such as formation fluid, and members 210 (e.g., probes), where the members 210 may include their own ports for receiving fluid (not pictured).

In this example, there are two visible members 210, but it should be appreciated that there may be more or fewer members 210. For example, the members 210 may be arranged at particularly circumferential positions about the sampling segment 202. By way of example, there may be two members 210, each arranged 180 degrees apart; three members 210, each arranged 120 degrees apart; four members 210, each arranged 90 degrees apart; six members 210, each arranged 60 degrees apart; or any other reasonable configuration. In various embodiments, the members 210 may be mounted in one or more configurations (not pictured) to permit radial expansion of the members 210 away from the sampling segment 202. One non-limiting example of the one or more configuration is extendable members that extend and retract relative to the sampling segment 202, where the extendable members may be mechanically driven, fluidly driven, electrically driven, or combinations thereof, among other options. That is, the members 210 may move away from the body of the sampling segment 202 toward the formation, for example toward and/or against a formation wall.

Further illustrated in FIG. 2A are components 212, 214 (e.g., packers, member elements, members, expandable elements) positioned between the upper segment 204 and the sampling segment 202 and between the lower segment 206 and the sampling segment 202, respectively. The components 212, 214 may be inflatable type, which may also be referred to as straddle packers. In operation, the components 212, 214 may be activated to expand radially outward and against a formation wall, which effectively seals or otherwise isolates a sample region 216 that substantially correspond to the sampling segment 202. In various embodiments, the components 212, 214 may include bands or pads 218, which may be used to facilitate sealing and or for strengthening purposes.

It should be appreciated that a sampling distance 220 may be particularly selected based, at least in part, on one or more formation properties. Accordingly, relative positions of the components 212, 214 may be adjusted. That is, the components 212, 214 may be axially movable to increase or decrease the testing and sampling distance 220. In certain embodiments, the testing and sampling distance 220 is selected at an uphole location and then different tool portions are coupled together to set the sampling distance 220, where tool portions may include spacers or other subs in order to increase the sampling distance 220. In at least one embodiment, the components 212, 214 may be movable after deployment within the wellbore. For example, the components 212, 214 may be positioned on tracks and driven by one or more motors to slide along the tracks, thereby permitting an increase or a decrease in the testing and sampling distance 220. In various embodiments, the tracks may have a predetermined maximum and minimum position for the sampling distance 220. It should be appreciated that adjusting the testing and sampling distance 220 may enable changes or modifications to pumping requirements to clean out the sample region 216.

In operation, one or both of the ports 208 and/or the members 210 may be utilized for formation testing and sampling. By way of example, in a first mode of operation, the components 212, 214 may deploy to effectively isolate the sample region 216. The sample region 216 may fill with a fluid, for example formation fluids, which may be driven, at least in part, by one or more pumps that generate suction at the ports 208. Additionally, in various embodiments, the members 210 may also be deployed to engage the wellbore wall (or be positioned close to the wellbore wall) and also obtain formation properties and samples. In this manner, each of the different sampling modalities may be utilized. As an alternative, the members 210 may not be used when the components 212, 214 are deployed, and only the ports 208 may collect a sample. As another alternative, the components 214, 214 may not be deployed and only the members 210 may be used to obtain the formation samples. Accordingly, various different operational modes are enabled by the tool configuration of FIG. 2A.

Figure 2B:
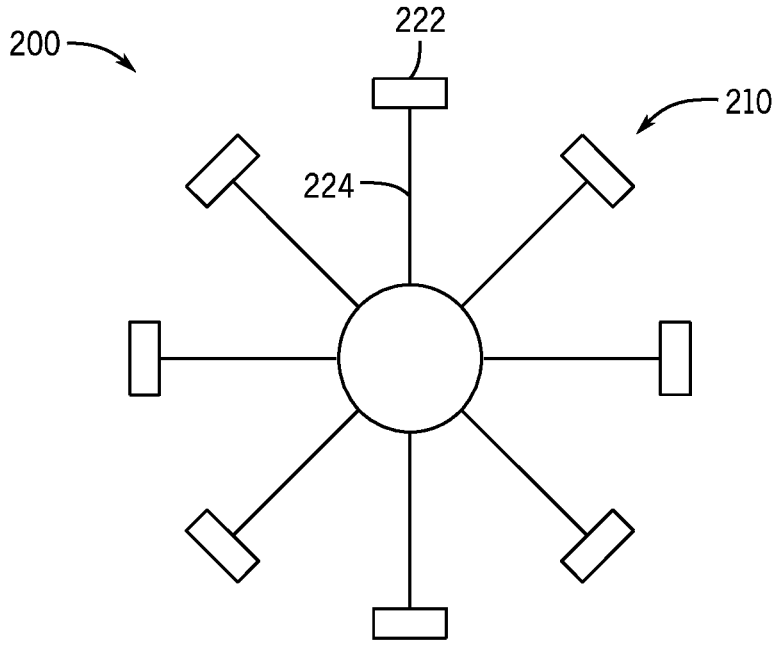
FIG. 2B is a top view of an embodiment of a testing and sampling tool, in accordance with embodiments of the present disclosure.

FIG. 2B is a top schematic view of an embodiment of the tool 200 illustrating a configuration of the members 210. In this example, there are eight members 210 each arranged circumferentially about the sampling segment 202. As shown, respective member ends 222 (e.g., probe ends) are positioned on respective member arms 224 (e.g., arms) that are used to drive the member ends 222 radially outward and away from the tool body. For example, the arms 224 may be associated with one or more devices, such as motors, drives, and the like, that are actuated responsive to a control signal to transition a member end 222 away from the tool body. It should be appreciated that the arms 224 and/or the members 210 may be individually controllable such that a position of one member is not necessarily equivalent to another. In this manner, member ends 222 may be positioned based on their relative position within a wellbore, which may not be concentric in various embodiments. Furthermore, it should be appreciated that the illustrated configuration is by way of example only and there may be more or fewer members 210 utilized with different embodiments, and moreover, the probes 210 may be in different positions.

Figure 3:
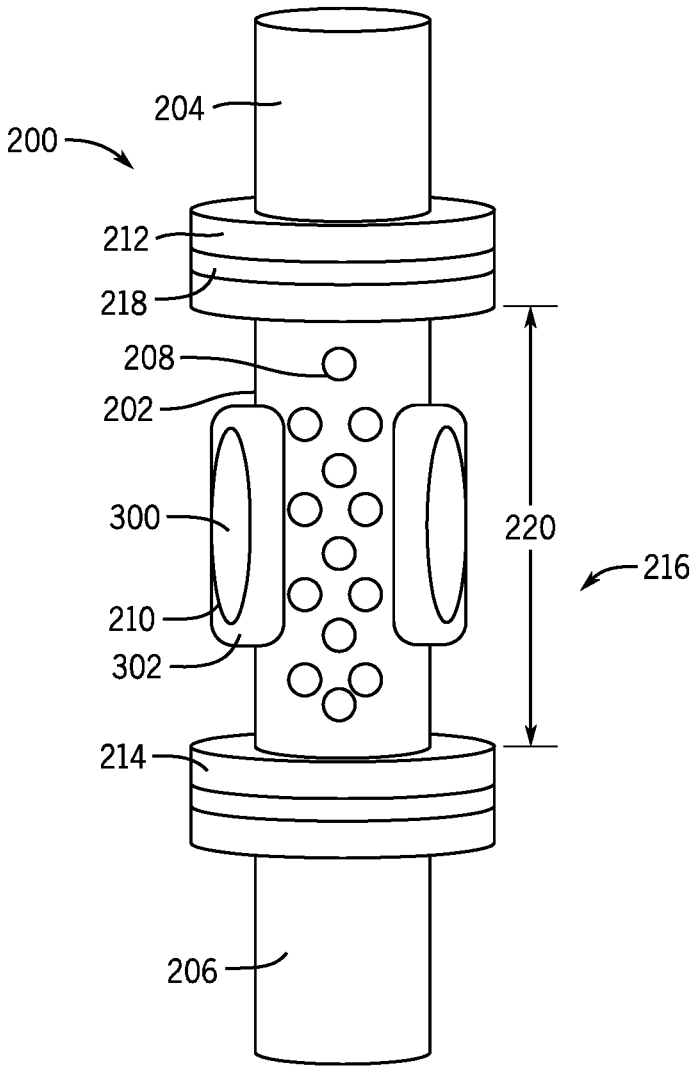
FIG. 3 is a schematic side view of an embodiment of a testing and sampling tool, in accordance with embodiments of the present disclosure.

FIG. 3 is a schematic view of an embodiment of the tool 200 in which additional ports 208 are included. It should be appreciated that any reasonable number of ports 208 may be included within the sampling segment 202 to facilitate collection of fluid samples. For example, ports 208 may be distributed at different circumferential positions around the sampling segment 202 to provide 360 degree fluid acquisition. Additionally, the number of ports 208 at different regions may vary.

In this example, member ports 300 (e.g., probe ports) are also illustrated on the member(s) 210, along with the member elements 302 (e.g., probe packers). For example, in operation, the member ports 300 may be pressed up against the formation and may be sealed and/or isolated by the member element 302. A smaller area around the member ports 300 may allow for reduced suction pressures due to the smaller area.

Figure 4A:
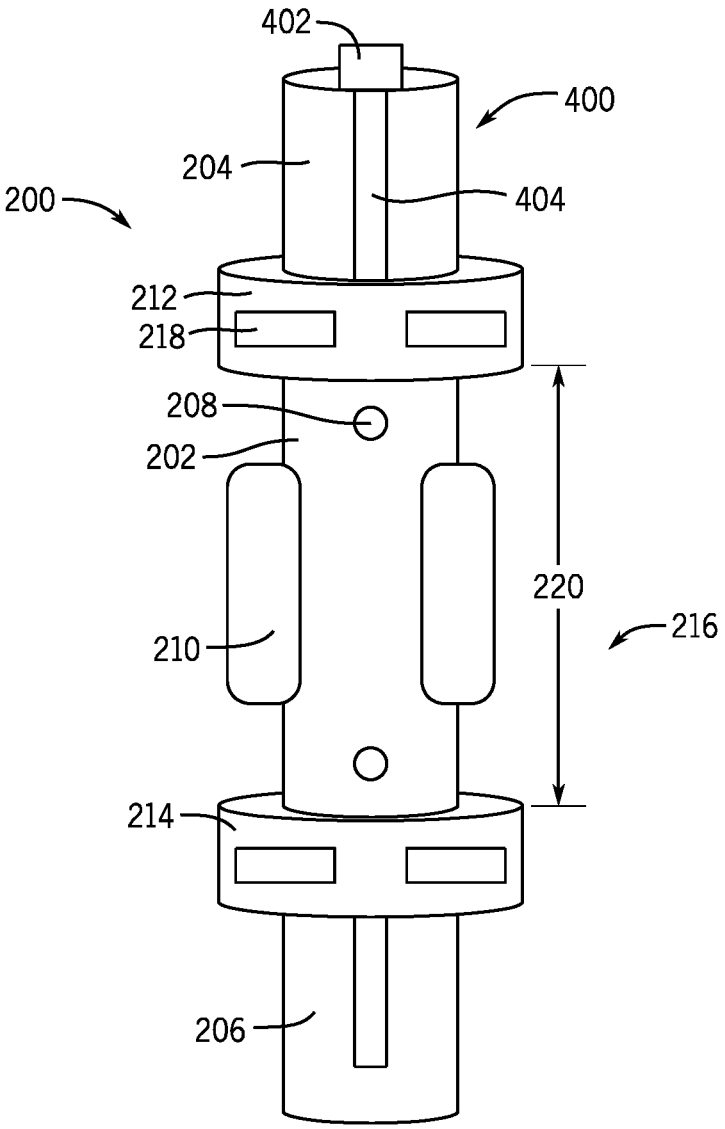
FIG. 4A is a schematic side view of an embodiment of a testing and sampling tool, in accordance with embodiments of the present disclosure.

FIG. 4A is a schematic view of an embodiment of the tool 200 in which the components 212, 214 are configured to move between different axial positions via a component movement system 400 (e.g., packer movement system). In this example, the component movement system 400 includes a drive element 402 (e.g., a motor, a hydraulic pump, etc.) to drive movement of one or more of the components 212, 214 along a pathway 404 (e.g., tracks). For example, an interior portion of the component 212 may include a mating coupler, such as a rail, (not pictured) that engages the pathway 402 to permit axial movement of the components 212, 214. The drive element 402 may receive one or more control signals to move the components 212, 214, thereby adjusting the sampling distance 220. It should be appreciated that the movement system 400 is provided by way of example and that alternative configurations may be utilized for adjusting the axial position of the components 212, 214.

Figure 4B:
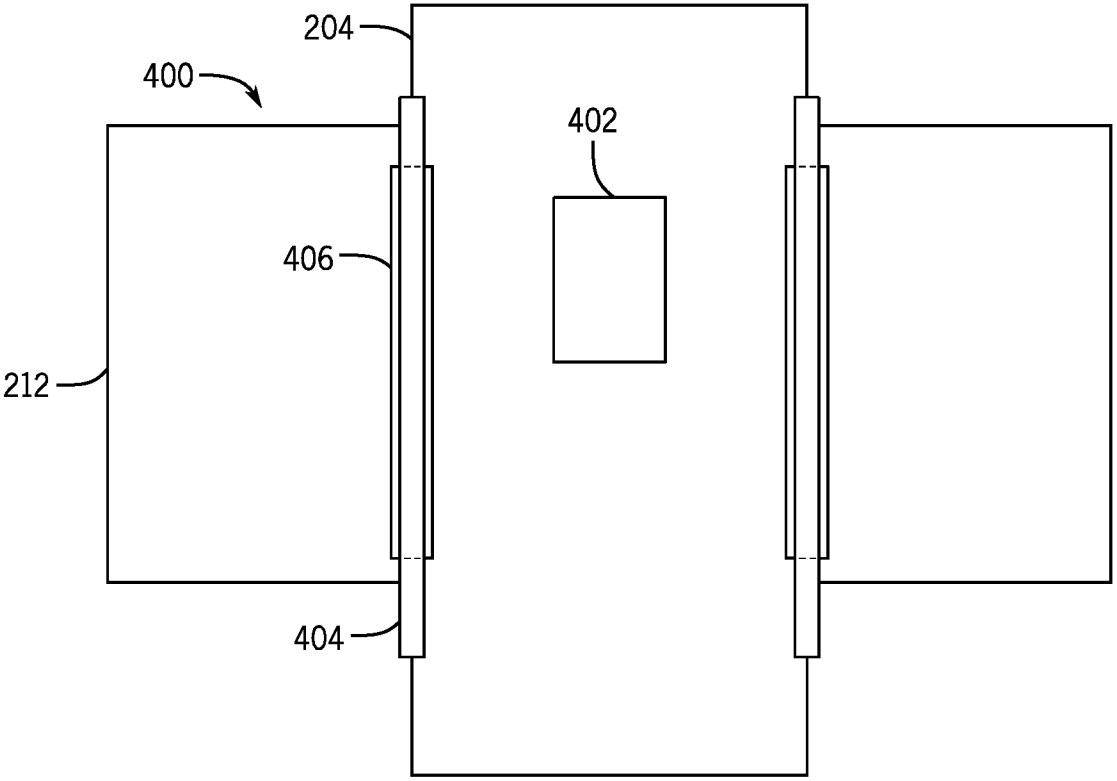
FIG. 4B is a cross-sectional side view of an embodiment of a member movement system of a testing and sampling tool, in accordance with embodiments of the present disclosure.

FIG. 4B is a schematic cross-sectional view of an embodiment of the tool 200 in which the component movement system 400 includes the drive element 402 for driving the component 212 along the pathway 404. As shown, the interior of the component 212 includes a mating coupler 406 that couples to the pathway 404, thereby guiding movement of the component 212. In various embodiments, the drive element 402 may receive a control signal to initiate movement of the component 212, for example by driving the component 212 to move along the pathway 404, thereby adjusting an axial position of the component 212.

FIGS. 5A-5D illustrate operational modes for the tool 200. It should be appreciated that the modes may be selected based on different operating parameters, and moreover, that multiple modes may be used for a single sampling operation.

Figure 5A:
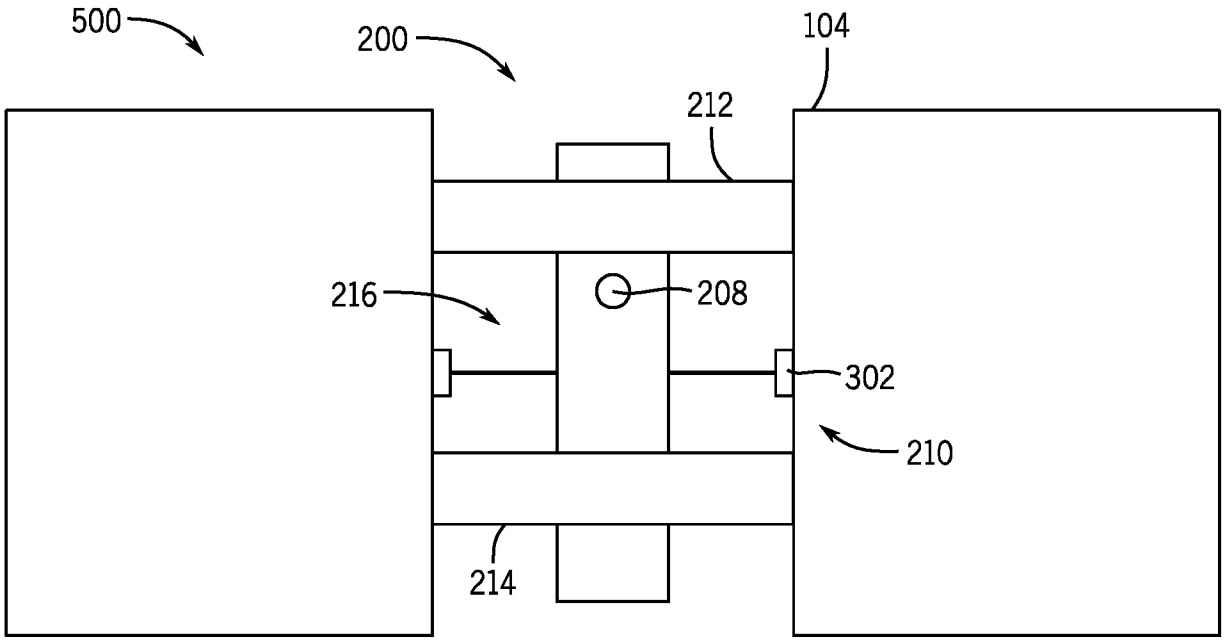
FIGS. 5A-5D are schematic side views of embodiments of testing and sampling tool operational modes, in accordance with embodiments of the present disclosure.

FIG. 5A is a schematic side view of an embodiment of the tool 200 arranged within the wellbore 104. In this example, the tool 200 may be considered as using a first operational mode 500, which may correspond to a mode where both the port 208 and the member ports 300 are collecting samples. As shown, the components 212, 214 are deployed to engage the wellbore 104, thereby substantially isolating the sampling region 216. Accordingly, one or more pumps may be engaged to drive fluid toward the port 208. Additionally, samples may be acquired via the members 210, which are also extended such that the member element(s) 302 engage the wellbore 104, thereby providing an isolation zone for the member ports 300 to collect fluid.

Figure 5B:
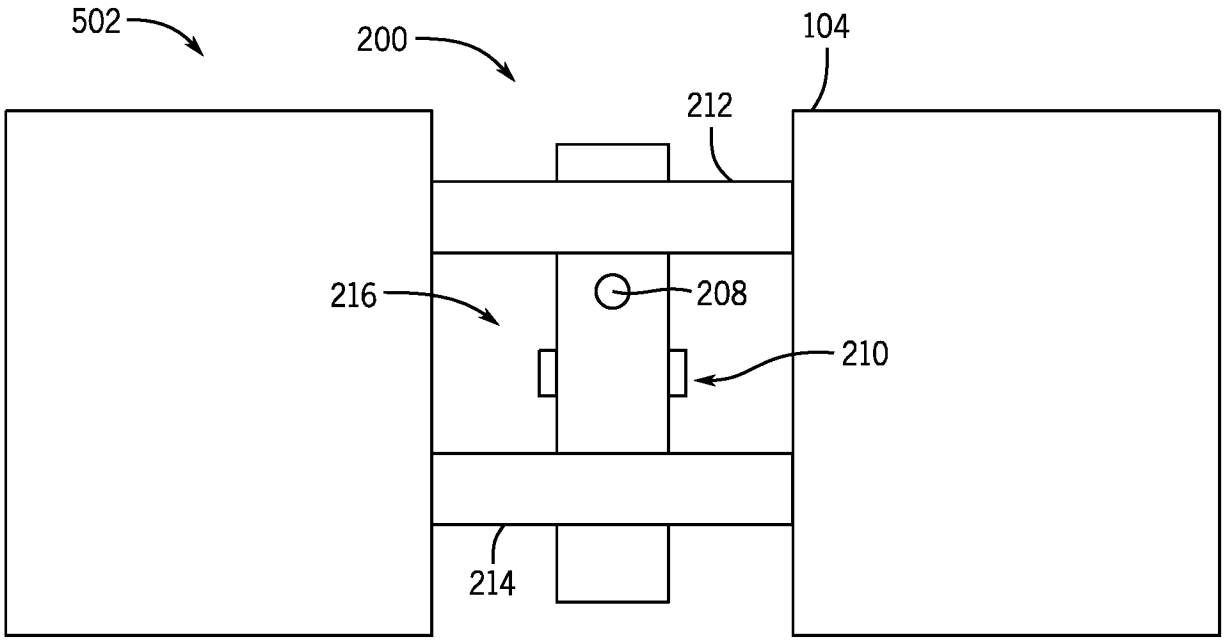

FIG. 5B is a schematic side view of an embodiment of the tool 200 arranged within the wellbore 104 and configured to operate in a second operational mode 502. In this example, the second operational mode corresponds to a mode where only the port 208 is collecting samples. As shown, the components 212, 214 are deployed to engage the wellbore 104, thereby substantially isolating the sampling region 216. Accordingly, one or more pumps may be engaged to drive fluid toward the port 208. However, when compared to FIG. 5A, samples may not be acquired via the members 210, which are not extended, which may be referred to as being disengaged.

Figure 5C:
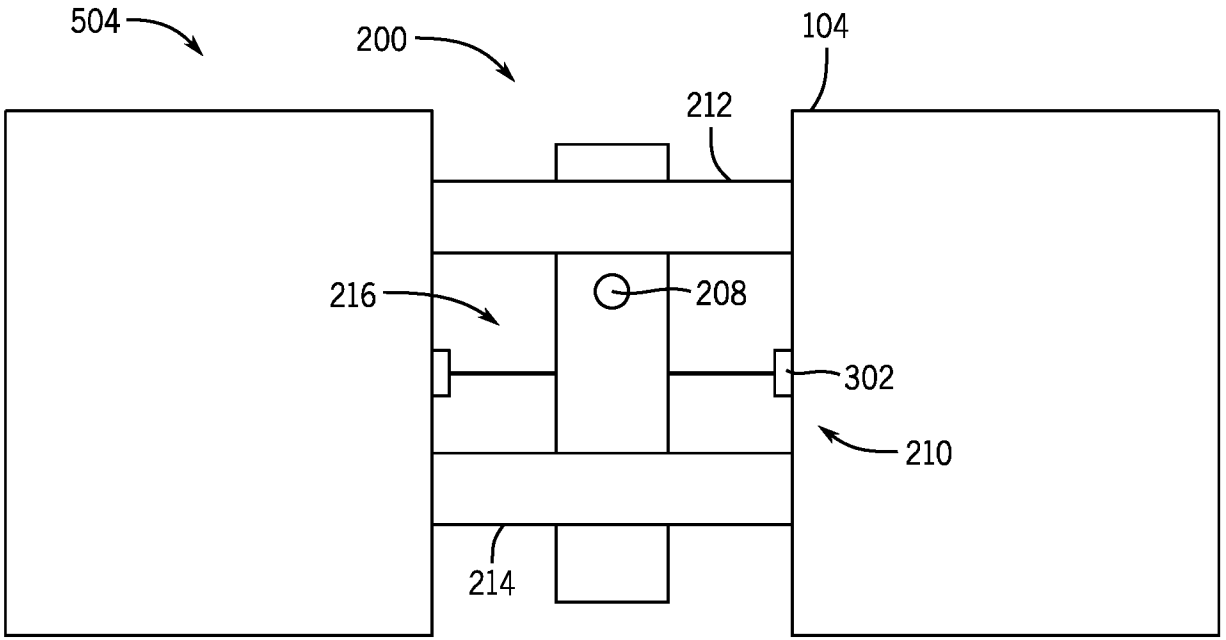

FIG. 5C is a schematic side view of an embodiment of the tool 200 arranged within the wellbore 104 and configured to operate in a third operational mode 504. In this example, the third operational mode corresponds to a mode where only the members 210 are collecting samples. As shown, the components 212, 214 are deployed to engage the wellbore 104, thereby substantially isolating the sampling region 216. However, the port 208 is not drawing in fluid, which may be referred to as being disengaged, but rather the members 210 are extended such that the member elements 302 engage the wellbore 104, thereby providing an isolation zone for the member ports 300 to collect fluid. It should be appreciated that, in various embodiments, the members 210 may not be in contact with the wellbore 104, but may be closely positioned to the wellbore 104.

Figure 5D:
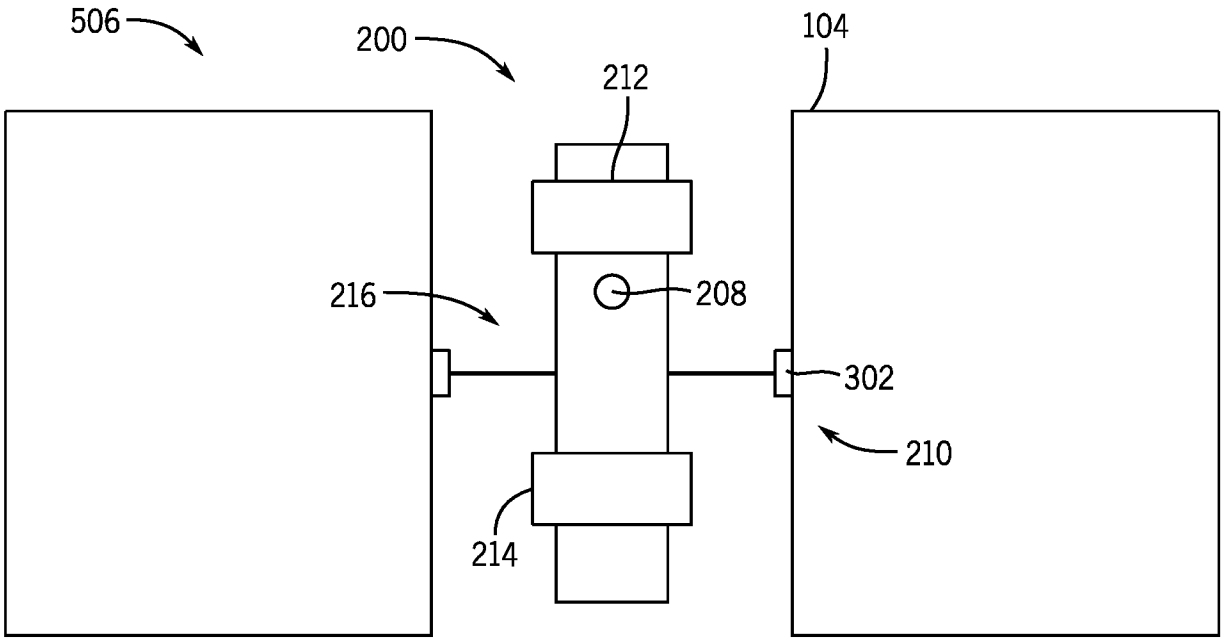

FIG. 5D is a schematic side view of an embodiment of the tool 200 arranged within the wellbore 104 and configured to operate in a fourth operational mode 506. In this example, the fourth operational mode corresponds to a mode where only the members 210 are collecting samples and additionally, where the components 212, 214 are not deployed, which may be referred to as being disengaged. In this example, the members 210 are extended such that the member elements 302 engage the wellbore 104, thereby providing an isolation zone for the member ports 300 to collect fluid. It should be appreciated that, in various embodiments, the members 210 may not be in contact with the wellbore 104, but may be closely positioned to the wellbore 104. Accordingly, FIGS. 5A-5D illustrate a variety of different operational modes that may be used with embodiments of the present disclosure. Accordingly, different sampling configurations may be selected, at least in part, on different wellbore or formation parameters.

Figure 6:
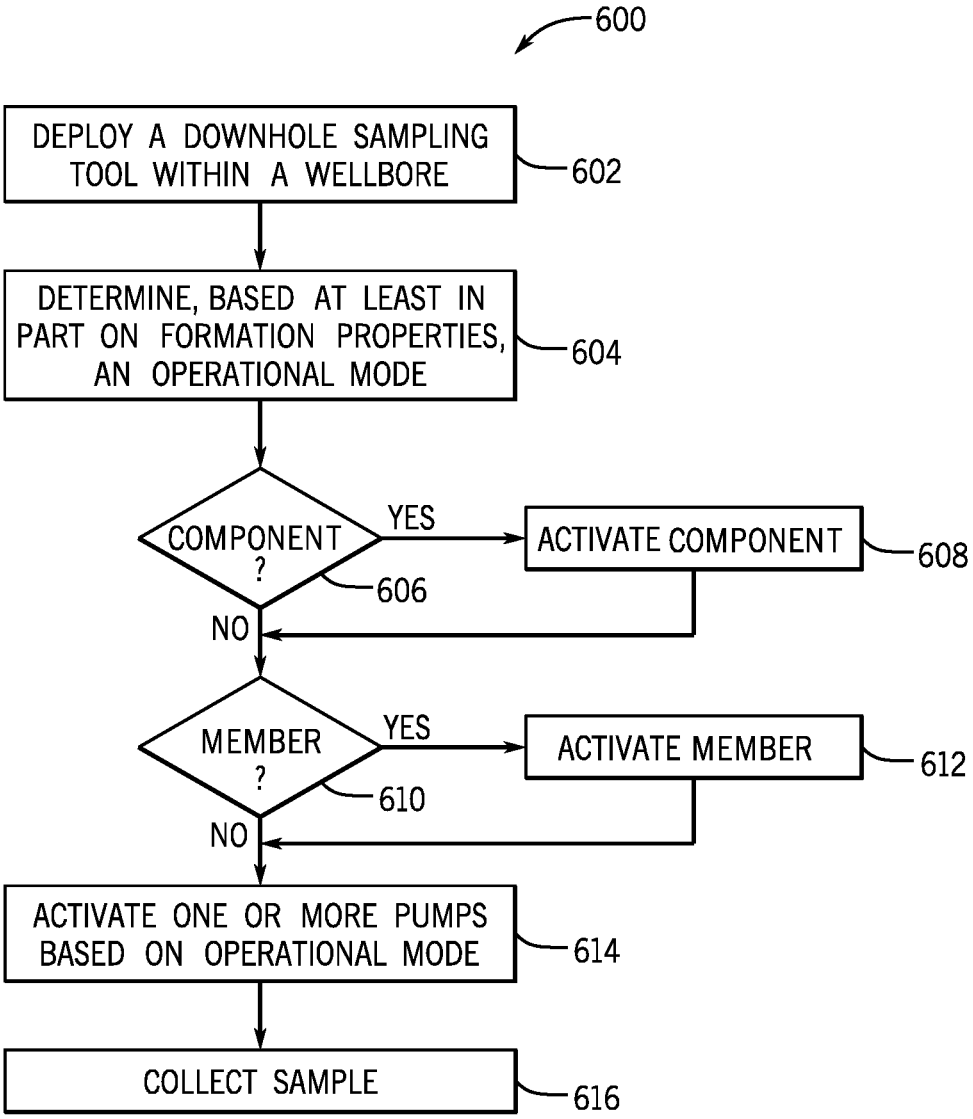
FIG. 6 is a flow chart of an embodiment of a method for testing and collecting downhole fluid samples, in accordance with embodiments of the present disclosure.

FIG. 6 is a flow chart of an embodiment of a process 600 for performing a downhole measurement. It should be appreciated that for this process, and all processes described herein, that there may be more or fewer steps. Additionally, the steps may be performed in a different order, or in parallel, unless otherwise specifically stated. In this example, a downhole sampling tool is deployed into a wellbore 602. The tool may be a sampling tool that enables multiple different modes of operation, for example, by selecting one or more different sampling modules associated with the tool. Formation properties may, at least in part, be used to determine an operational mode 604. For example, formation mobility may determine which mode of operation to use, among other information.

In various embodiments, different modes of operation may use different sampling modules associated with the tool. For example, one or more modules may use components, such as packers. As such, it may be determined whether or not components should be deployed 606. If so, then the components may be activated 608. If not, then a further determination may be made with respect to whether members, such as probes, should be deployed 610. If so, then the members may be activated 612. One or more pumps may then be activated to draw fluid from the formation 614. The pumps may draw fluid for a period of time in order to collect a sample 616. In this manner, multiple different operational modes that may include multiple different sampling modules may be integrated into a single tool and utilized to collect formation samples.

The foregoing disclosure and description of the disclosed embodiments is illustrative and explanatory of various embodiments of the present disclosure. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. A formation testing and sampling tool for downhole fluid collection, comprising:
- a first component being deployable to expand against a wellbore wall;
- a second component being deployable to expand against the wellbore wall; and
- a testing and sampling segment between the first component and the second component, the sampling segment comprising:
  - a fluid port extending into a body of the sampling segment, the fluid port being coupled to a pump to draw fluid from a sampling region into the sampling segment; and
  - one or more members positioned on the body of the sampling segment, the one or more members being deployable to extend radially away from the body;
- wherein each of the first component, the second component, the fluid port, and the one or more members are collectively deployable in a first tool configuration, a second tool configuration, a third tool configuration, or a fourth tool configuration.

2. The testing and sampling tool of claim 1, wherein the first tool configuration corresponds to a tool configuration in which the first component is deployed, the second component is deployed, the fluid port draws fluid from the sampling region corresponding to a volume between the first component and the second component, and the one or more members are deployed to engage the wellbore wall.

3. The sampling tool of claim 1, wherein the second tool configuration corresponds to a tool configuration in which the first component is deployed, the second component is deployed, the fluid port draws fluid from the sampling region corresponding to a volume between the first component and the second component, and the one or more members are disengaged.

4. The testing sampling tool of claim 1, wherein the third tool configuration corresponds to a tool configuration in which the first component is deployed, the second component is deployed, the fluid port is disengaged, and the one or more members are deployed to engage the wellbore wall.

5. The testing and sampling tool of claim 1, wherein the fourth tool configuration corresponds to a tool configuration in which the first component is disengaged, the second component is disengaged, the fluid port is disengaged, and the one or more members are deployed to engage the wellbore wall.

6. The testing and sampling tool of claim 1, wherein the one or more members comprise:
- a member port to receive a fluid flow;
- a member element to seal against the wellbore wall; and
- a member arm to radially extend the one or more members outward and away from the sampling segment.

7. The testing and sampling tool of claim 1, wherein a distance between the first component and the second component corresponds to a sampling distance, the sampling distance being adjustable.

8. The testing and sampling tool of claim 7, wherein the sampling distance is adjustable at an uphole location prior to installing the testing and sampling tool into the wellbore.

9. The testing and sampling tool of claim 7, wherein the sampling distance is adjustable at a downhole location after installing the testing and sampling tool into the wellbore.

10. A downhole testing and sampling system, comprising:
- a downhole tool;
- a conveyance system; and
- a testing and sampling tool forming a portion of the downhole tool, the sampling tool comprising:
  - a first sampling modality;
  - a second sampling modality, wherein one or both of the first sampling modality or the second sampling modality are selectively deployed to collect a formation sample;
  - a first component;
  - a second component; and
  - a sampling segment between the first component and the second component,
- wherein a distance between the first component and the second component is adjustable to change a length of the sampling segment.

11. The downhole testing and sampling system of claim 10, wherein the first sampling modality includes a port formed in the sampling segment, the port drawing the formation sample from an isolated region formed after both the first component and the second component are deployed to engage a wellbore wall.

12. The downhole testing and sampling system of claim 10, wherein the second sampling modality includes a member coupled to the sampling segment, the member being radially movable away from the sampling segment to engage a wellbore wall, the member having a member element that forms an isolated region to collect the formation sample.

13. The downhole testing and sampling system of claim 12, wherein the member may be deployed after at least one of the first component or the second component are deployed to engage the wellbore wall.

14. The downhole testing and sampling system of claim 12, wherein the member may be deployed without deploying the first component or the second component.

15. The downhole testing and sampling system of claim 10, wherein at least one of a first component position or a second component position is adjusted while the testing and sampling tool is within a wellbore.

16. A method for collecting a formation sample, comprising:

positioning a first expandable component at a first axial location along a body of a sampling tool;

positioning a second expandable component at a second axial location along the body of the sampling tool, wherein a distance between the first axial location and the second axial location is a configurable sampling distance;

deploying the sampling tool into a wellbore;

deploying a tool configuration, of a plurality of tool configurations, for the first expandable component, the second expandable component, a fluid port, and one or more radially extendable members;

activating, based on the tool configuration, at least one of the first expandable component, the second expandable component, the fluid port, or the one or more radially extendable members; and collecting the formation sample and properties using one or more sampling modalities associated with the sampling tool.

17. The method of claim 16, wherein the first expandable component and the second expandable component are activated to form a sampling region, further comprising:

drawing, from the sampling region, the formation sample via the fluid port, wherein the fluid port is formed in one or both of a sampling segment of the sampling tool or a radially extendable ember of the one or more radially extendable members.

* * * * *